US005121106A

United States Patent [19]

Kataria et al.

[11] Patent Number: 5,121,106

[45] Date of Patent: * Jun. 9, 1992

[54] ELECTRONIC ARTICLE SURVEILLANCE MARKERS WITH DIAGONAL DEACTIVATION ELEMENTS

[75] Inventors: Vibha R. Kataria, Westport; Claude Zeller, Monroe, both of Conn.

[73] Assignee: Pitney Bowes Inc., Stamford, Conn.

[ * ] Notice: The portion of the term of this patent subsequent to Jun. 9, 2009 has been disclaimed.

[21] Appl. No.: 636,154

[22] Filed: Dec. 31, 1990

[51] Int. Cl.[5] ..... G08B 13/14

[52] U.S. Cl. ..... 340/572; 340/551

[58] Field of Search ..... 340/572, 551

[56] References Cited

U.S. PATENT DOCUMENTS 4,710,754 12/1987 Montean ..... 340/572

*Primary Examiner*—Jin F. Ng
*Assistant Examiner*—Christine K. Oda
*Attorney, Agent, or Firm*—Peter Vrahotes; Melvin J. Scolnick; David E. Pitchenik

[57] ABSTRACT

A deactivable electronic article surveillance marker having elongated magnetically soft elements on a support in a criss-cross pattern with a plurality of magnetically semi-hard chips parallel to one another in rows with the rows being diagonally aligned relative to the elongated magnetically soft elements. In another embodiment, strips of magnetically semi-hard material are placed diagonally relative to the elongated magnetically soft elements. In both embodiments, the elongated magnetically soft elements can be in the form of a fiber.

12 Claims, 1 Drawing Sheet

ELECTRONIC ARTICLE SURVEILLANCE MARKERS WITH DIAGONAL DEACTIVATION ELEMENTS

BACKGROUND OF THE INVENTION

A high degree of interest has been shown over the past years in the field of theft detection using electronic article surveillance systems wherein magnetically sensitive devices, known as markers, are introduced into a time varying magnetic field, known as an interrogation zone, to emit a signal in response to such magnetic field. Electronic article surveillance (EAS) systems and markers for use therein were disclosed by P. A. Picard in French Patent Number 763,681 (1934). Generally, certain ferromagnetic alloys exhibit high magnetic permeability and low coercivety thereby making their use as EAS marker attractive. Materials for such markers have been made as disclosed in U.S. Pat. Nos. 4,581,524 and 4,568,921 and U.S. Patent application having Ser. No. 290,547. Although these markers generally work well, without the ability to deactivate such markers, i.e., rendering then unresponsive in an interrogation zone, the use of EAS systems becomes limited. For example, when an article with a marker attached thereto is purchased in a first store and the purchaser subsequently enters a second store with the article bearing the marker, the marker could generate an alarm in the EAS system of the second store unless measures are taken to avert the same. As is generally known, there are walk around systems as used in institutions such as libraries where the books are checked out. Thereafter, the individual walks through the gates of the EAS system without the book and is then given the book as it is passed around the gates. Although this system works well in controlled areas, such as libraries, it is not adequate in the commercial use of EAS systems.

In U.S. Pat. No. 3,747,086, a deactivable marker is described that has a soft magnetic strip which is detectable in an interrogation zone of an EAS system. In addition to such soft magnetic strip, two hard magnetic strips sandwich the soft magnetic strip and these have distinctive magnetic properties which are not the same as the detectable soft magnetic strip. After a marker has been used for the purposes of theft detection, it is then magnetized by placing the marker in a magnetic field of high strength to magnetize the two hard magnetic strips elements thereby rendering the marker undetectable. Although this marker functions adequately, as required, it requires a proper orientation of the marker during deactivation because of the anisotropic nature of the configuration. Furthermore, such a scheme does not lend itself to deactivating soft ferromagnetic fibers. In addition, use of such a large amount of hard magnetic material is expensive.

It clearly would be advantageous to provide an EAS marker that can be readily deactivated in a magnetic field without concern as to orientation of the marker during deactivation, particularly where the soft magnetic elements are in the form of a fiber.

BRIEF SUMMARY OF THE INVENTION

This invention is concerned with the field of theft detection using an electronic article surveillance (EAS) system. More particularly, it is directed to deactivable EAS markers. Elongated magnetically soft elements responsive to an interrogation zone are aligned in crisscross fashion in a marker so as to provide a signal when introduced into an interrogation zone of an EAS system. Magnetically semi-hard elements having a coercivity of 100 to 300 Oe are included in the marker with the magnetically semi-hard elements being placed diagonally relative to the elongated magnetically soft elements. The magnetically semi-hard elements can be in the form of small rectangular or circular chips placed in bands which bands are directed diagonally relative to the elongated soft magnetic element in a first preferred embodiment. Upon magnetization of the magnetically semi-hard elements, the marker becomes undetectable in an interrogation zone. With such diagonal alignment configuration, the marker can be deactivated in a magnetic field with little concern for the direction of the magnetizing field. In a second preferred embodiment the magnetically semi-hard elements are in the form of strips which are aligned diagonally relative to the elongated magnetically soft elements.

BRIEF DESCRIPTION OF THE DRAWING

With reference to the drawing wherein like numbers are used for like elements.

DETAILED DESCRIPTION OF THE PREFERRED EMBODIMENT

Figure 1:
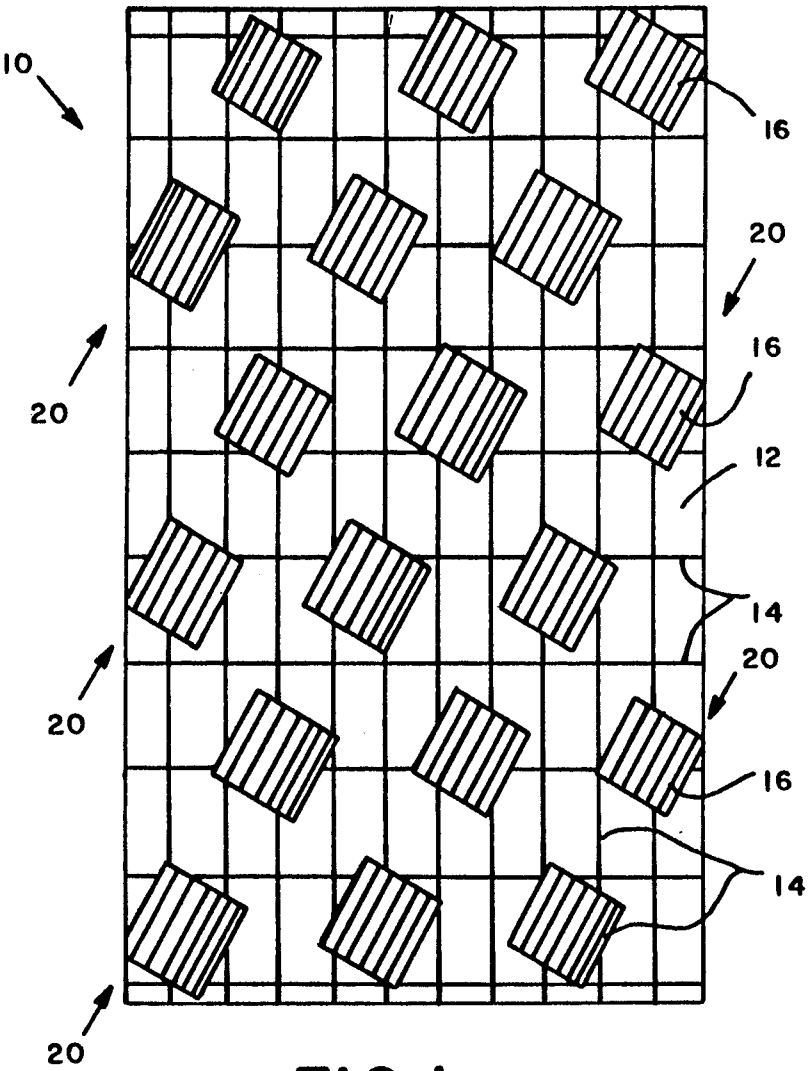
FIG. 1 is a plan view of an EAS marker made in accordance with the instant invention.

With initial reference to FIG. 1, an EAS marker is shown generally at 10 and includes a support 12, such as paper, plastic tape and the like, to which two sets of a plurality of elongated, parallel magnetically soft elements 14 are attached, each set being perpendicular to the other, which is defined as a criss-cross configuration. As shown, the magnetically soft elements 14 are in the form of fibers as described in U.S. Patent Application Ser. No. 290,547 and have a coercivity of 0.1 to 0.8 Oersted (Oe). Although the invention is described in conjunction with the use with fibers, it will be appreciated that other forms of elongated magnetically soft materials may be used such as in strips, as described in U.S. Pat. No. Re 32,427, or wires, as described in U.S. Pat. No. 4,568,921.

The magnetically soft fibers 14 are attached to the support 12 as by an adhesive. Normally a marker 10 will have the elements 14 secured by a second support member that overlies the first support member 12 and is adhered thereto as by adhesives, but for purposes of clarity and convenience, the invention will be described as using only one support member. In any case, the soft magnetic fibers 14 form a crisscross or checkerboard pattern with two perpendicular sets of fibers, which fibers are generally parallel to one another within each set. The magnetically soft fibers 14 have a coercivity of 0.1 to 0.8 Oe and a relative permeability of 20,000 to 150,000. Overlying the magnetically soft fibers 14 are a plurality of magnetically semi-hard chips 16 made of a material such as vicalloy (38% Fe, 50% Co and 12% V). Generally, the magnetically semi-hard chips will have a coercively of 50 to 250 Oersteds (Oe) and a remanence of 6,000 to 10,000 Gauss. For a marker 10 with a support member 12 having a dimension of 0.75 in.×1.2 in., the chips preferably have a size of 0.11 in.×0.11 in. to 0.14 in. ×0.14 in or a diameter of 0.11 in to 0.14 in. if circular. The closest distance between the centers of the chips is preferably 0.20 in to 0.25 in. The thickness of the chips 16 is approximately one mil. Although the chips 16 are shown in FIG. 1 as being rectangular, it has been found circular chips perform equally well. The chips 16 can also be irregularly shaped. The chips 16 are preferably made by rapid solidification methods such as splat cooling.

As can be seen, the magnetically semi-hard chips 16 are aligned in a plurality of diagonally extending rows 20 relative to the patterned magnetically soft fibers 14, five such of magnetically semi-hard chips being seen in FIG. 1 with two to six chips in each row. The rows 20 of chips 16 are generally parallel to one another and overlap of the fibers 14. Such a marker 10 is readily deactivated in a magnetic field of 50 to 250 Oe. This is substantially less of a field than if the markers were made of hard magnetic materials.

A sheet of one mill thick vicalloy was cut into chips 16 of a size 0.12 in.×0.12 in. and placed on a support 12. The magnetically soft fibers 14 were then placed on the support 12 in a crisscross pattern. Both the chips 16 and the fibers 14 were secured to the support member by an adhesive. This marker was placed in an interrogation zones where the field varied from approximately 1 Oe to 2 Oe and was readily detectable. The marker was then placed in a magnetic field of 100 Oe which magnetized the magnetically semi-hard chips. After such magnetization, the marker 10 was no longer detectable in an interrogation zone.

With the chips located on the marker 10 in bands with a diagonal configuration relative to the fibers 14 as seen in FIG. 1, after magnetization of the chips the flux from the chips biases the fibers 14 oriented along the x-direction as well as the fibers oriented along the y-direction. This diagonal configuration of chips 16 completely deactivates a marker with a criss-cross pattern of fibers 14.

With the diagonal magnetically semi-hard chips 16 cut into small pieces as is shown in FIG. 1, the amount of material required is reduced so that there is only 27%-33% coverage of the support member 12. This configuration works for any direction of magnetization. It also possesses translational symmetry.

Figure 2:
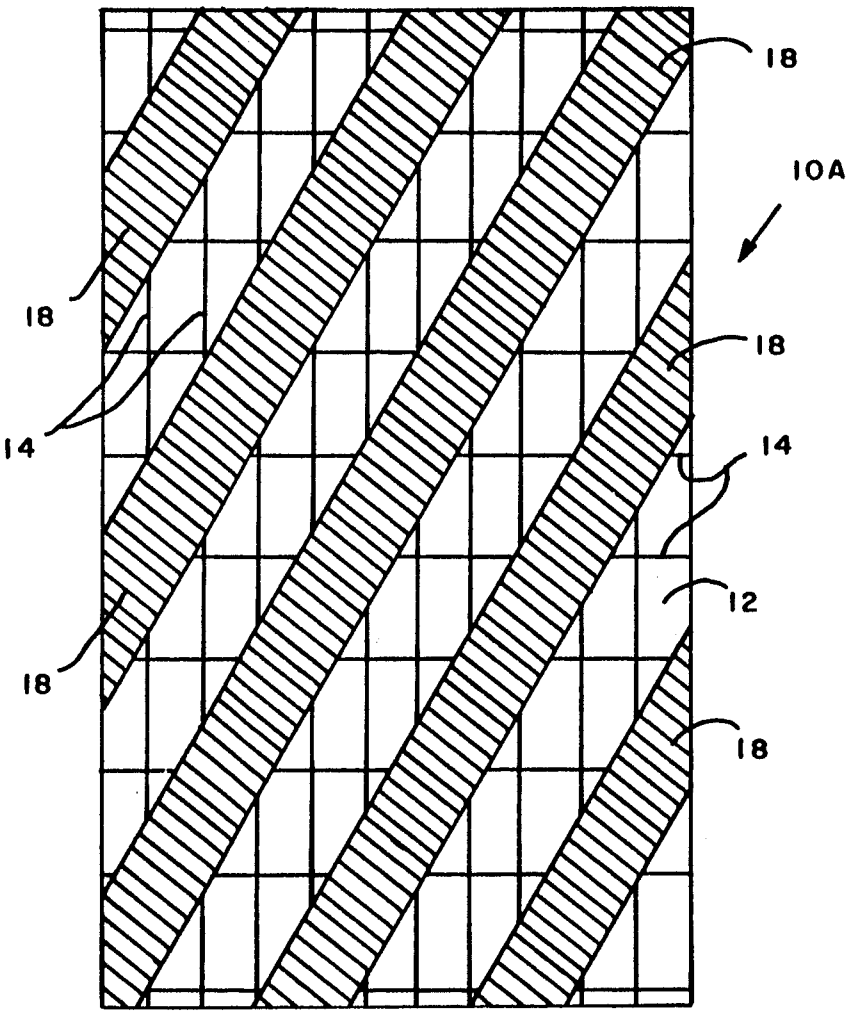
FIG. 2 is a plan view of an alternative structure of an EAS marker made in accordance with the instant invention.

With reference now to FIG. 2, a second preferred embodiment of the instant invention is shown in connection with a marker 10A having a support 12 and fibers 14 aligned as previously described. Magnetically semi-hard strips 18 are aligned parallel to one another and diagonally relative to the fibers 14. Each of the strips 18 overlies the fibers 14. Using this configuration, it has also been found that markers 10A with a crisscross configuration of fibers 14 are produced that are readily deactivatable in a field having a strength of 50 to 250 Oe. The advantage of the second preferred embodiment is the ease of manufacture, although a higher amount of material is required.

What is claimed is:

1. An electronic article surveillance marker comprising:

a support member, a plurality of elongated magnetically soft elements supported by said support member in a generally criss-cross configuration, and a plurality of magnetically semi-hard chips supported by said support member and overlapping said elongated magnetically soft elements and formed in parallel rows, said rows of magnetically semi-hard chips being generally parallel one another and extending diagonally relative to said elongated magnetically soft elements.

2. The electronic article marker of claim 1 wherein said magnetically soft elements have a coercivity of 0.1 to 0.8 Oe.

3. The electronic article surveillance marker of claim 2 wherein said magnetically semi-hard chips have a coercivity of 50 to 250 Oe.

4. The electronic article surveillance marker of claim 3 wherein said elongated magnetically soft elements are fibers.

5. The electronic elongated article surveillance marker of claim 1 wherein said elongated magnetically soft elements are strips.

6. The electronic article surveillance marker of claim 3 wherein said elongated magnetically soft elements are wires.

7. An electronic article surveillance marker comprising:

a support member, a plurality of elongated magnetically soft elements supported by said support member in a generally crisscross pattern, and a plurality of magnetically semi-hard strips supported by said support member adjacent to said elongated magnetically soft elements, said semi-hard magnetic strips being generally parallel to one another and extending diagonally relative to said elongated soft magnetic elements.

8. The electronic article surveillance marker of claim 7 wherein said semi-hard strips have a coercivity of 50 to 250 Oe.

9. The electronic article surveillance marker of claim 8 wherein said magnetically soft elements have of coercivity of 0.1 to 0.8 Oe.

10. The electronic article surveillance marker of claim 9 wherein said elongated magnetically soft elements are fibers.

11. The electronic article surveillance marker of claim 9 wherein said elongated magnetically soft elements are wires.

12. The electronic article surveillance marker of claim 9 wherein said elongated magnetically soft elements are strips.

* * * * *